US005358753A

United States Patent [19]

Rao et al.

[11] Patent Number: 5,358,753

[45] Date of Patent: Oct. 25, 1994

[54] METHOD OF MAKING AN ANTI-FRICTION COATING ON METAL BY PLASMA SPRAYING POWDER HAVING A SOLID LUBRICANT CORE AND FUSABLE METAL SHELL

[75] Inventors: V. Durga N. Rao, Bloomfield Hills; Daniel M. Kabat, Oxford; Robert A. Rose, Grosse Pointe Park, all of Mich.

[73] Assignee: Ford Motor Company, Dearborn, Mich.

[21] Appl. No.: 133,412

[22] Filed: Sep. 24, 1993

Related U.S. Application Data

[62] Division of Ser. No. 88,486, Jul. 6, 1993, Pat. No. 5,302,450.

[51] Int. Cl.[5] ..... B05D 1/12

[52] U.S. Cl. ..... 427/451; 427/450; 427/455; 427/456; 29/888.061

[58] Field of Search ..... 427/450, 451, 455, 456, 427/217; 29/888.048, 888.061; 148/254

[56] References Cited

U.S. PATENT DOCUMENTS

| | | | |
|---|---|---|---|
| 1,654,509 | 12/1927 | Claus . | |
| 3,659,861 | 5/1972 | Rao et al. | 277/96 |
| 3,930,071 | 12/1975 | Rao et al. | 427/203 |
| 4,221,828 | 9/1980 | Sato et al. | 427/217 |
| 4,872,432 | 10/1989 | Rao et al. | 123/193 CP |
| 5,080,056 | 1/1992 | Kramer et al. | 123/193 CP |
| 5,217,814 | 6/1993 | Kawakami et al. | 428/545 |
| 5,239,955 | 8/1993 | Rao et al. | 29/888.048 |

FOREIGN PATENT DOCUMENTS

| | | | |
|---|---|---|---|
| 56-53091 | 12/1981 | Japan | 427/451 |
| 58-164785 | 9/1983 | Japan | 427/450 |
| 60-251264 | 10/1985 | Japan | 427/451 |
| 02-204028 | 8/1990 | Japan . | |

*Primary Examiner*—Terry J. Owens

*Attorney, Agent, or Firm*—Joseph W. Malleck; Roger L. May

[57] ABSTRACT

A method of making an anti-friction coating on a metal surface subject to sliding wear, including the steps of: forming an encapsulated powder having grains made of a core of solid lubricants including at least graphite and $MoS_2$ (others may include BN, NaF, LiF, $CaF_2$, and $WS_2$), and a thin shell of fusable soft metal such as Ni, Co, Fe, Zn, Sn, Mg, or Cu; plasma spraying the powder onto a light metal surface, such as a cylinder bore wall of an internal combustion engine, to form a coating; and finish-smoothing the coating to a uniform thickness of about 25–175 microns. Some core particles may be hard, wear-resistant particles such as SiC, NiCrAl, FeMn, FeCrAl, FeWNiVCr, NiCrMoVW, FeCrMoWV, CoFeNiCrMoWV, NiCrMoV, and CoMoCrVW.

13 Claims, 8 Drawing Sheets

METHOD OF MAKING AN ANTI-FRICTION COATING ON METAL BY PLASMA SPRAYING POWDER HAVING A SOLID LUBRICANT CORE AND FUSABLE METAL SHELL

This is a divisional application of U.S. Ser. No. 08/088,486 filed Jul. 6, 1993, now U.S. Pat. No. 5,302,450.

BACKGROUND OF THE INVENTION

1. Technical Field

This invention relates to the art of fluid lubricated metal wear interfaces or contacts, and more particularly to the use of anti-friction solid film lubricants for such interfaces modified to withstand high unit scraping or bearing loads at high temperatures while functioning with either full or partial fluid lubrication.

2. Discussion of the Prior Art

The utility of certain solid film lubricants for bearings has been known for some time. U.S. Pat. No. 1,654,509 (1927) discloses use of powder graphite trapped or covered by a metal binder (i.e., iron, aluminum, bronze, tin, lead, babbitt, or copper) to form a thick coating; all of the metal is heated to at least a thermoplastic condition by melting or arc spraying to bury the graphite. The coating offers limited friction reducing characteristics. Unfortunately (i) the graphite is not exposed except by significant wear of the metal, thus never realizing significantly lower friction; (ii) the metal is in a molten condition prior to trapping or burying the graphite causing thermal effects and distortions; and (iii) oxides of the metal serve as the primary lubricant. The prior art has also appreciated the advantage of thermally spraying (by oxy-fuel) aluminum bronze as a solid film lubricant onto cylinder bore surfaces of an engine as demonstrated in U.S. Pat. No. 5,080,056. The lubricating quality of such coating at high temperatures is not satisfactory because (i) it lacks compatibility with piston ring materials which usually comprise cast iron, molybdenum coated cast iron, or electroplated hard chromium; and (ii) thermal spraying of the material by oxy-fuel is not desirable because of very high heat input necessitating elaborate tooling to rapidly dissipate heat to avoid distortion of its coated part.

One of the coauthors of this invention has previously disclosed certain solid lubricants operable at high temperatures, but designed for interfacing with ceramics, not metals, and generally at low load applications in the absence of any liquids. One solid lubricant disclosed comprised graphite and boron nitride in a highly viscous thermoplastic polymer binder spread in a generous volume onto a seal support comprised of nickel and chromium alloy. The formulation was designed to provide a hard coating which softens at the surface under load while at or above the operating temperature and functioning only under dry operating conditions. Thermoplastic polymer based formulations are unsatisfactory in meeting the needs of a loaded engine component, such as a cylinder bore, because the unit loads are significantly higher (approaching 500 psi), and the surface temperatures are higher, causing scraping. Another solid lubricant disclosed was halide salts or $MoS_2$ (but not as a combination) in a nickel, copper, or cobalt binder; the coating, without modifications, would not be effective in providing a stable and durable anti-friction coating for the walls of an internal combustion cylinder bore, because the formulations were designed to operate under dry conditions and against ceramics, primarily lithium aluminum silicate and magnesium aluminum silicate, and, thus, the right matrix was not used nor was the right combination of solid lubricants used. Particularly significant is the fact that the formulations were designed to produce a ceramic compatible oxide (e.g., copper oxide or nickel oxide) through partial oxidation of the metal in the formulation. These systems were designed to permit as much as 300–500 microns wear. In the cylinder bore application, only 5–10 micron wear is permitted.

It is an object of this invention to provide a plasma sprayable powder for coating a light metal (e.g., alloys of either aluminum, magnesium, or titanium with silicon, zinc, tin, or copper, etc.) cylinder bore surface of an internal combustion engine, the powder having a soft metal encapsulating certain selected solid lubricant particles therein ($CaF_2$, $MoS_2$, LiF), and, optionally, having soft metal encapsulating hard, wear resistant particles. The encapsulation promotes improved fusion to the light metal bore surface and promotes a lace-like network of fusion metal between particles.

Another object is to provide a coating composition that economically reduces friction for high temperature applications, particularly along a cylinder bore wall at temperatures above 700° F. when oil lubrication fails or in the presence of oil flooding (while successfully resisting conventional or improved piston ring applied loads).

Another object of this invention is to provide a lower cost method of making coated cylinder walls by rapidly applying a coating by plasma spraying requiring less energy and at reduced or selected areas of the bore wall while achieving excellent adherence and precise deposition with a larger powder grain size, the method demanding less rough and machine finishing of the bore surface.

Still another object is to provide a coated aluminum alloy cylinder wall product for an engine that (i) assists in achieving reduced piston system friction and reduced piston blow-by, all resulting in improved vehicle fuel economy of 2–4% for a gasoline powered vehicle; (ii) reduces hydrocarbon emissions; and (iii) reduces engine vibration by at least 20% at wide-open throttle conditions at moderate speeds (i.e., 1000–3000 rpm).

SUMMARY OF THE INVENTION

The invention, in a first aspect, is a thermally sprayable powder, having powder grains comprising: (a) a core of solid lubricant particles comprising at least graphite and $MoS_2$; and (b) a thin, soft metal shell encapsulating such core. Additional powder grains can comprise other solid lubricants of the group consisting of hexagonal BN, LiF, $CaF_2$, $WS_2$, and eutectic mixtures of $LiF/CaF_2$ or $LiF/NaF_2$; additional powder grains can comprise hard, wear-resistant particles selected from the group consisting of SiC, NiCrAl, and intermetallic compounds such as FeWNiVCr, NiCrMoVW, FeCrMoWV, CoFeNiCrMoWV, NiCrMoV, and CoMoCrVW (known as lave phase). The soft metal for the shell is selected from the group consisting of Ni, Co, Cu, Zn, Sn, Mg, and Fe.

The invention in another aspect is a solid lubricant coating system for a metal wear interface subject to high temperatures and wet lubrication, comprising: (a) particles of oil-attracting solid lubricants comprised of at least graphite and $MoS_2$, (b) soft metal shells encapsulating the particles and being fused together to form a network of grains constituting a coating fusably adhered to the metal interface, the coating having a porosity of 2–10% by volume. The coating has a deposited thickness in the range of 40–250 microns, and is desirably honed to a thickness of about 25–175 microns.

The invention in still another aspect is a method of making an anti-friction coating on a metal surface subject to sliding wear, comprising: (a) forming an encapsulated powder having grains comprising essentially a core of solid lubricants of graphite and $MoS_2$, and a thin shell of fusable soft metal; (b) plasma spraying the powder onto a light metal surface to form a coating; and (c) finish-smoothing of the coating to a uniform thickness of about 25–175 microns. The light metal surface is constituted of a metal or alloyed metal selected from the group consisting of aluminum, magnesium, and titanium, the light metal surface being cleansed to freshly expose the light metal or metal alloy just prior to plasma spraying.

Yet another aspect of this invention is an engine block having one or more anti-friction coated cylinder bore walls, comprising: (a) a metal engine block having at least one metal cylinder wall; (b) a coating of grains fused to the cylinder bore wall, the grains each being comprised of solid lubricant particles encapsulated within a soft metal shell, the shells being fused together to form a network with limited porosity, the solid lubricant comprising graphite and $MoS_2$; and (c) wet oil lubrication retained within the porosity of the coating. The soft metal of the coating will have a hardness no greater than 50 Rc (preferably Rc 20–30); the soft metal may additionally comprise a small amount of alloy metal adherently compatible with the cylinder bore wall metal.

DETAILED DESCRIPTION AND BEST MODE

To achieve a significant reduction in the coefficient of friction at high temperatures between normally oil-bathed metal contact surfaces, loaded to at least 10 psi, the coating system cannot rely on graphite or any one lubricant by itself, but rather upon a specific combination of solid lubricant particles encapsulated in soft metal shells that are easily fusable to each other and to the metal of the sliding interface, while retaining a desired porosity.

Figure 3:
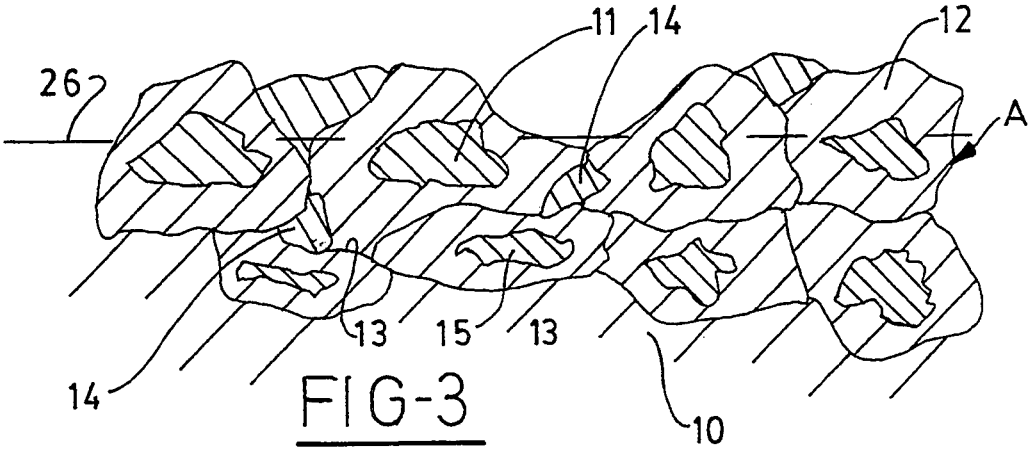
FIG. 3 is a schematic microscopic view of a segment of the as-deposited coating system of this invention.

As shown in FIG. 3, the inventive system comprises a layer A of powder grains adhered to a metal substrate or wall 10, each grain possessing a core 11 of solid lubricant particles and a soft metal shell 12 fused to adjacent shells at contact areas 13 resulting in a fused network that possess pores 14. The solid lubricant particles must comprise at least graphite and $MoS_2$, respectively present in the coating A, in amounts of, by weight, 30–70% and 30–90% of the lubricant core. It is desirable to additionally include certain other solid lubricant particles selected from the group consisting of boron nitride, calcium difluoride, lithium fluoride, sodium fluoride, eutectic mixtures of $LiF/CaF_2$ or $LiF/NaF_2$, and tungsten disulfide. When these other solid lubricant particles are present in the coating they should be present in the amount of about 5–20% by weight of the lubricant cores. The cores of certain particles may also be constituted of hard, wear-resistant particles 15, such as selected from the group consisting of silicon carbide, FeCrAl, NiCrAl, or FeCrMn steel and lave phases such as intermetallic compounds of FeWNiVCr, NiCrMoVW, FeCrMoWV, CoFeNiCrMoWV, NiCrMoV, and CoMoCrVW. The wear-resistant particles should be present in a minor amount controlled to be in the range of 5–25% by weight of the total cores. Such wear-resistant particles 15, in such controlled amount, facilitate the following function: when uniformly distributed in submicron size particulates in the grain matrix, they act as load carriers and, with proper honing, produce adjacent relieved areas that retain oil and solid lubricant reservoirs.

Figure 1:
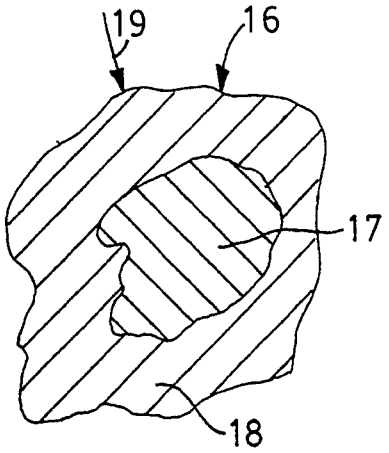
FIG. 1 is a highly enlarged view of one type of powder grain embodying this invention.

The powder, useful as a raw material in creating the coating system, is comprised of powder grains 16 containing a core of solid lubricant (see FIG. 1). The grains 16 have a core 17 of solid lubricant surrounded by an encapsulating soft metal shell 18 having a thickness 19 of about 5–40 microns, a volume ratio of the shell to the core in the range of 50:50 to 90:10, and a weight ratio of the shell to the lubricant core in the range of 70:30 to 95:5. The average grain size of the solid lubricant core grains is in the range of about 2–10 microns, and the hardness of the soft metal shell is no greater than Rc 40, preferably Rc 20. The soft metal shells are stable up to a temperature of at least 1200° F. when the soft metal shell is selected from the group described above.

Figure 2:
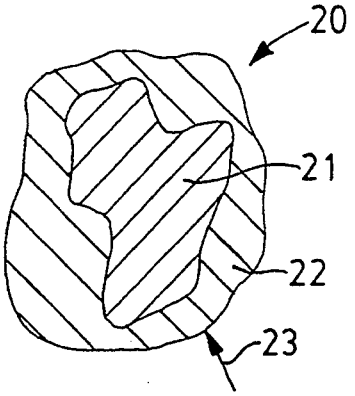
FIG. 2 is a view like FIG. 1, depicting another powder grain useful with this invention.

Powder grains 20 have hard, wear-resistant core particles 21 (see FIG. 2). Such grains have the wear-resistant core 21 comprised of the materials described above, encapsulated by a soft metal shell 22 (selected as a metal or metal alloy from Ni, B, Co, Cu, Zn, Sn, Mg, and Fe). Such grains also contribute to the reduction of friction since such metals oxidize on exposure to high temperature; the oxides, such as NiO, CoO, or $Cu_2O$, have an inherent low coefficient of friction. The thickness 23 of the soft metal shell is in the range of about 5–40 microns or 70–80% of the radial cross-section. The average grain size of the wear-resistant grains 20 is in the range of 0.2–5.0 microns, the volume ratio of the shell to the core is about 95:5 to 80:20, and the weight ratio is about 95:5 to 70:30.

The encapsulated solid lubricant particles may be created by a treatment wherein the solid lubricants are placed in a molten bath of the soft metal and stirred, and the slurry is then comminuted to form the encapsulated lubricant particles 16. The powder may also be made alternatively by spray drying; to this end, a water-based slurry of very fine particles of soft metal and of the solid lubricants is prepared. The slurry is blended with 0.5–1.5% by weight water soluble organic binder such as gum arabic and/or polyvinyl alcohol or CARBOWAX. The blended slurry is then atomized by hot spraying into a hot circulating air chamber at or about 300° F. A well-known method of the latter is hydrometallurgical deposition developed and commercially practiced by Skerritt-Gordon of Canada.

Figure 4:
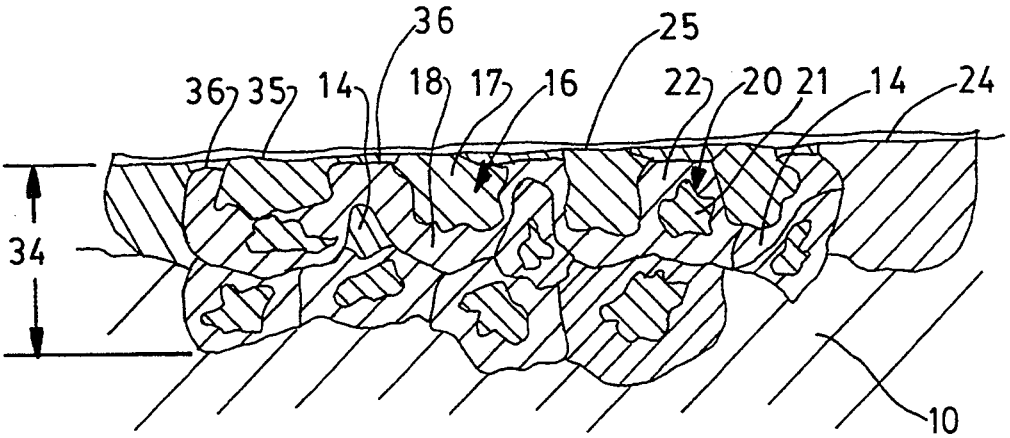
FIG. 4 is a view like that of FIG. 3, the coating having been honed and used in a sliding friction application.

As shown in FIG. 4, the preferred coating, when operatively used, will have a glazed or polished outer surface 24 as a result of engine start-up use or as a result of honing of the deposited particles along a honing line 26 (see FIG. 3). The coating will have a predetermined desirable amount of pores 14 which retain fluid oil for additional lubrication. The solid lubricants will be smeared or spread across the honed or polished surface 24 as a result of operative use at the sliding interfaces.

Figure 5:
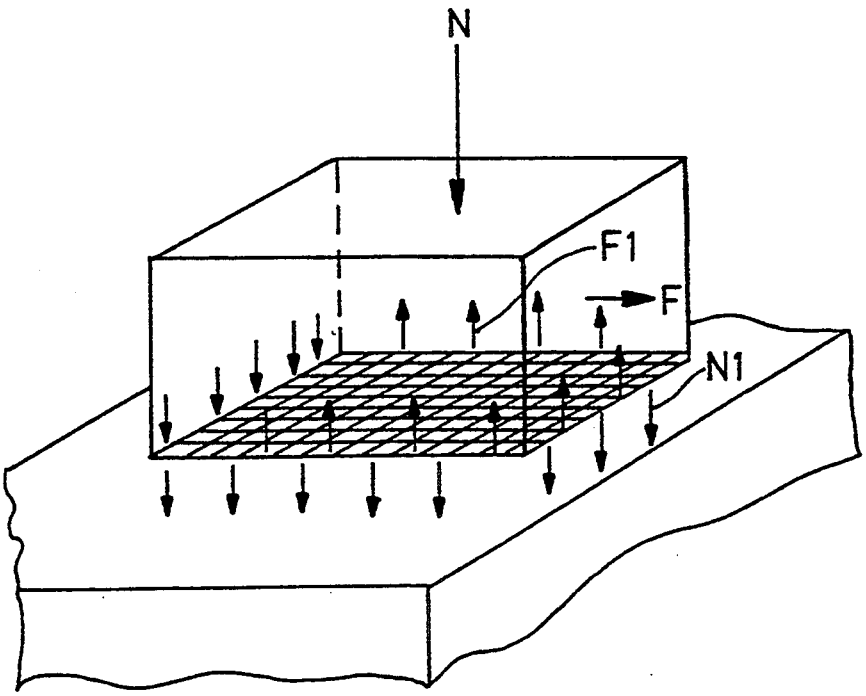
FIG. 5 is a schematic representation of the forces that influence coulomb friction.
Figure 6:
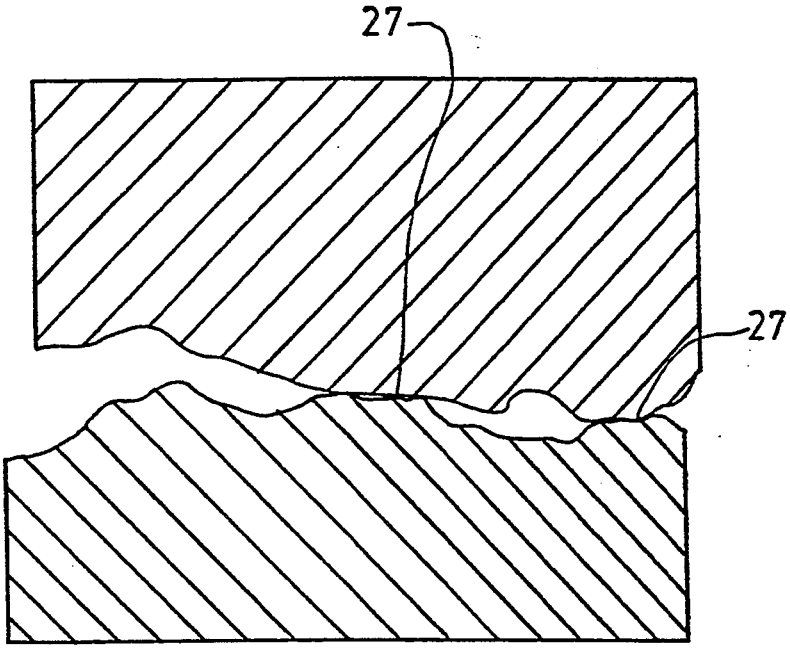
FIG. 6 is a highly enlarged microscopic view in cross-section of interfacing surfaces showing the irregularities of normal surfaces that affect coulomb friction.
Figure 7:
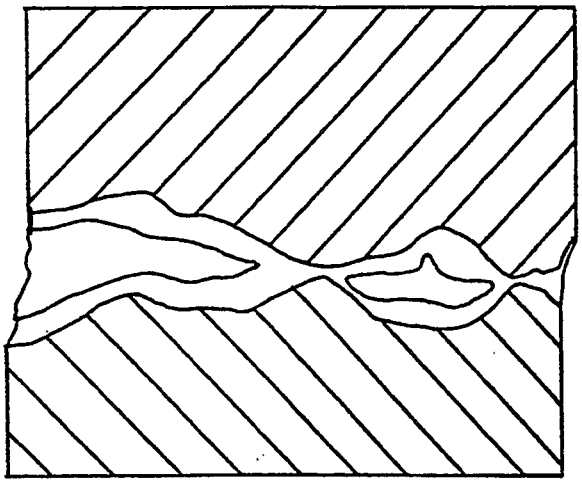
FIG. 7 is a view similar to FIG. 6 showing the incorporation of solid films on the interfacing surfaces that affect coulomb friction.

Friction in an oil-bathed environment will be dependent partly upon fluid friction and the oil film (layers in the fluid sheared at different velocities, commonly referred to as hydrodynamic friction), and, more importantly, dependent on dry or coulomb friction between contacting solid, rigid bodies (also referred to as boundary friction). Dry friction is tangential and opposed to the direction of sliding interengagement. As shown in FIG. 5, there is a visualization of the mechanical action of friction. The weight of a block imposes a normal force N on table C that is spread across several load forces N-1 at each interengaging hump 27 (see FIG. 6) (attributable to the interatomic bonds of the metal at the surface). The composite of all the tangential components of the small reaction forces F-1 at each of the interengaged humps 27 is the total friction force F. The humps are the inherent irregularities or asperities in any surface on a microscopic scale. When the interengaging surfaces are in relative motion, the contacts are more nearly along the tops of the humps and therefore the tangential reaction forces will be smaller. When the bodies are at rest, the coefficient of friction will be greater. Friction is influenced by the deformation and tearing of dry surface irregularities, hardness of the interengaged surfaces, and the presence of surface film such as oxides or oils. As a result, actual friction will be different from idealized perfect contact friction and will depend upon the ratio between shear and yield stresses of the interengaged surfaces. Thus, the presence of a film on each of the. interengaging surfaces (see FIG. 7) will serve to change the coefficient of friction depending upon the shear and yield stress capacities of the films and their relative hardness. Such films provide for shearing or sliding of boundary layers within the film to reduce friction. Such shearing is localized to essentially the areas where the humps provide hard support for the films. This localization reduces friction further.

Figure 8:
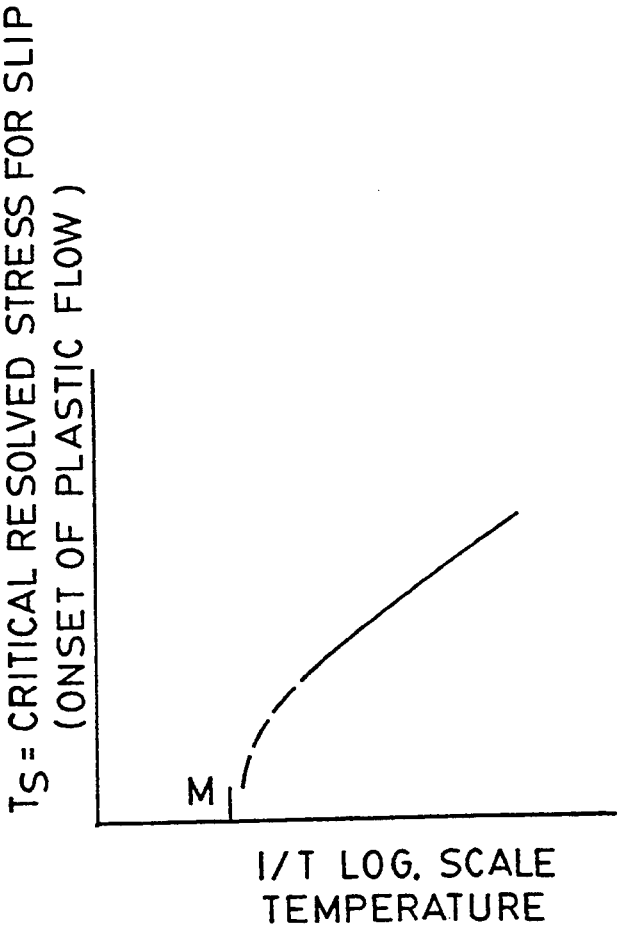
FIG. 8 is a graphical illustration of the onset of plastic flow of surface films as a function of stress and temperature.
Figure 9:
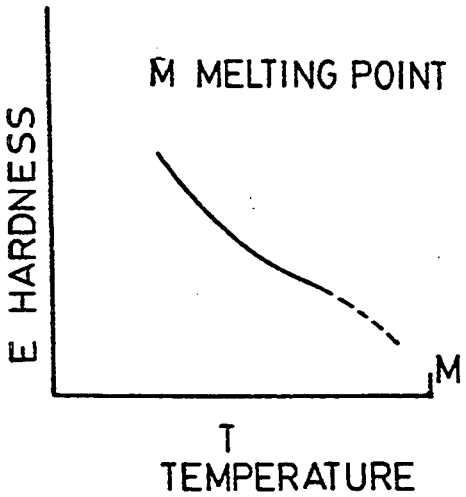
FIG. 9 is a graphical illustration of surface energy (hardness) as a function of temperature for surface films.

Friction is also influenced significantly by temperature because high local temperatures can influence adhesion at the contact points. As shown in FIG. 8, as temperature goes up, the critical stress for slip goes down, which increases the actual area of contact surface for the same applied load, thereby increasing friction. As shown in FIG. 9, as the temperature approaches melting, the hardness (E) goes down.

Figure 10:
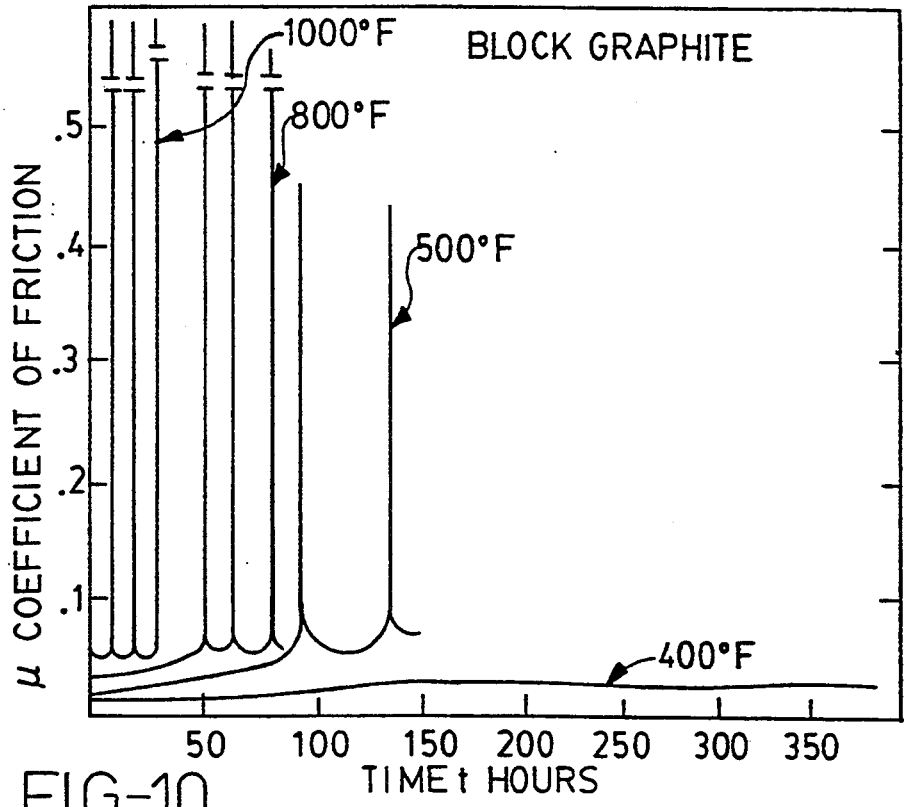
FIG. 10 is a graphical illustration of the coefficient of friction for block graphite as a function of time.
Figure 11:
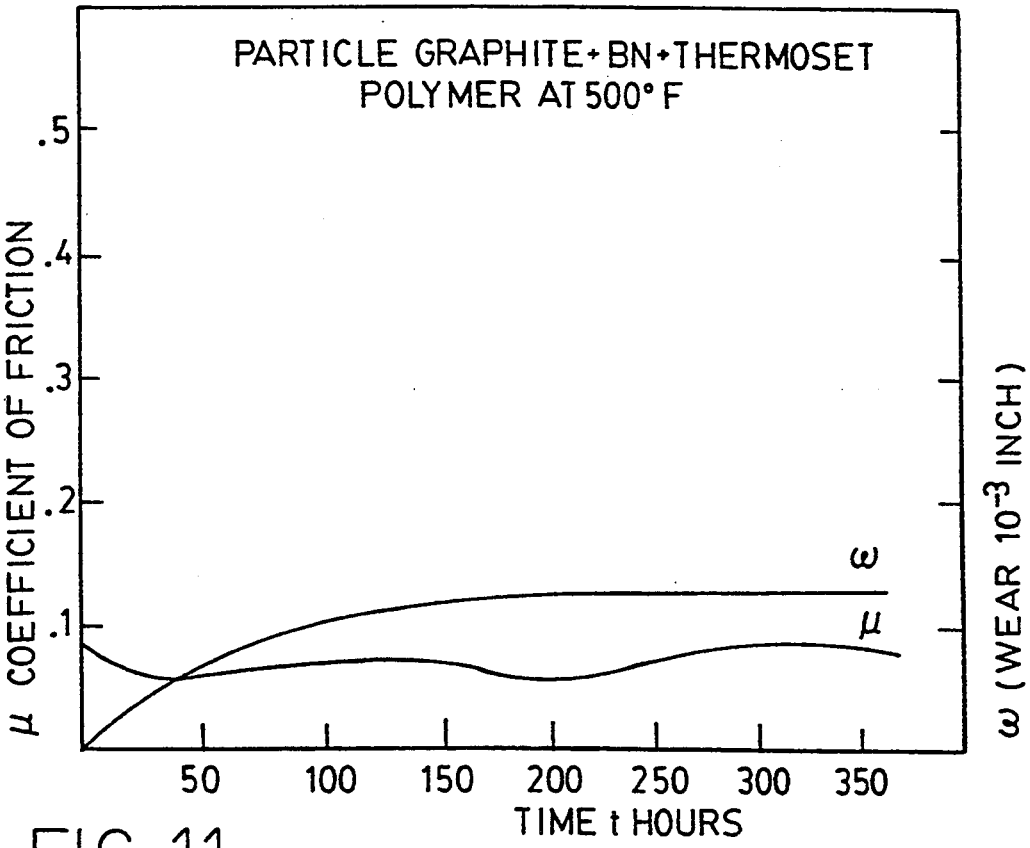
FIG. 11 is a graphical illustration of the coefficient of friction and also of wear as a function of time for the coating system of this invention tested at the temperature of 500° F.

The influence of temperature is particularly evident on graphite, as shown in FIG. 10. The coefficient of friction for block graphite rapidly increases to above 0.4 at 500° F. and above 0.5 at 800° F., and even higher at 1000° F. The coefficient of friction for graphite at 400° F. or lower becomes generally uniform at below 0.05. Contrast this with the coefficient of friction performance and wear performance of the coating system of this invention represented in FIG. 11. It should be noted that the coefficient of friction generally uniformly stays below 0.1, and wear is generally uniform at about 0.001"/100 hours at 500° F. (see FIG. 11). The coating for FIG. 11 comprises only particles of graphite and boron nitride in a temperature stable polymer.

At least graphite and molybdenum disulfide must be present in the solid lubricant particles in amount of 5–30% by weight of the coating. Graphite, as earlier indicated, is effective as a solid lubricant only up to temperatures around 400° F., and possesses very poor load bearing capability such as that experienced by a piston ring scraping against the graphite itself. Molybdenum disulfide should be present in an amount of 30–100% by weight of the solid lubricants, and, most importantly, is effective in increasing the load bearing capability as well as the temperature stability of the mixture up to a temperature of at least 580° F., but will break down into molybdenum and sulfur at temperatures in excess of 580° F. in air or nonreducing atmospheres. Molybdenum disulfide reduces friction in the absence of oil or in the presence of oil, and, most importantly, supports loads of at least 10 psi at such high temperatures. Molybdenum disulfide is also an oil attractor and is very useful in this invention, which must deal with wet lubrication.

Boron nitride, when selected, should be present in an amount of 5–50% by weight of the solid lubricants, and increases the stability of the mixture up to temperatures as high as 700° F. and concurrently stabilizes the temperature for the ingredients of molybdenum disulfide and graphite. Boron nitride is an effective oil attractor.

Calcium difluoride and lithium fluoride are oil attractors, and are stable up to the respective temperatures of 1500° F. and 1200° F. and resist loads of up to 50 psi or higher. These solid lubricants yield a dry coefficient of friction of 0.1–0.2.

Porosity allows wet oil to be retained in the pores of the coating as an impregnant during operation of the sliding contacts, particularly when the contacts are between a piston and a cylinder bore wall of an engine. The temperature stability of the coating is important because typical engine cylinder bore walls will experience, at certain zones thereof and under certain engine operating conditions such as failure of coolant or oil pump, temperatures as high as 700° F. even though the hottest zone of the cylinder bore surface in the combustion chamber under normal operating conditions is only about 540° F. The optimum solid lubricant mixture will contain lubricants beyond the graphite and molybdenum disulfide. The coefficient of friction for the coating grains in the as deposited condition will be in the range of 0.07–0.08 at room temperature and a coefficient of friction as low as 0.03 at 700° F.

To further enhance the solid lubricant mass beyond the exposed cores and smear film of FIG. 4, the coating system may further include an over-layer of a thermoset polymer emulsion containing more solid lubricants. The solid lubricant should comprise particles of at least two of graphite, $MoS_2$, and BN. The thermoset polymer may be comprised of a thermoset epoxy, such as bisphenol A present in an amount of 25–70% of the polymer, such epoxy being of the type that cross-links and provides hydrocarbon and water vapor transfer to graphite while attracting oil. The polymer also should contain a curing agent present in an amount of about 2–5% of the polymer such as dicyandiamide; the polymer may also contain a dispersing agent present in an amount of 0.3–1.5% such as 2, 4, 6 tri dimethylamino ethyl phenol.

The emulsion may comprise mineral spirits or butyl acetate that suspend the particles of solid lubricant and polymer. The emulsion may be applied to the substrate or engine bore wall by any variety of techniques, at room temperature, such as emulsion spraying, painting such as by roller, or a tape which carries the emulsion.

The soft metal of the powder shells may incorporate other metal alloying ingredients that are particularly compatible and adherent to the substrate or interface metal material. For example, it would be difficult to fusably adhere pure copper shells to an aluminum substrate; an alloy addition of 4–5% by weight aluminum to the shell metal promotes the needed fusion. It may be desirable to add 3–7% by weight of such alloying metal to the shell metal to promote fusion adhesion.

Method of Making Coated Surfaces

Figure 12:
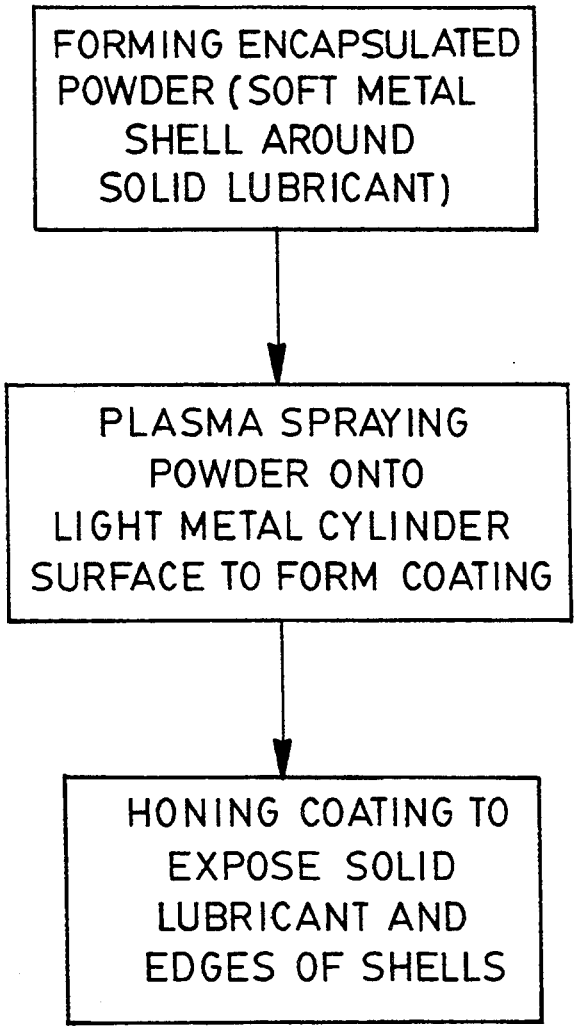
FIG. 12 is a block diagram showing schematically the steps involved in the method aspect of this invention.

As shown in FIG. 12, the comprehensive method of making coated surfaces, such as cylinder bore walls, according to this invention, comprises the steps: (a) forming an encapsulated powder having grains comprising a solid lubricant core of graphite and $MoS_2$, and a thin shell of fusable soft metal; (b) plasma spraying the powder onto a cleansed or freshly exposed light metal surface to form a coating; and (c) finish-smoothing of the coating to a thickness of about 25–60 microns.

Such method provides several new features that should be mentioned here. Plasma sprayed powder (i) will form a controlled porosity that allows for impregnation of wet oil; (ii) the encapsulated powder grains create asperities in the surface such that, when honed, the edges of the shell metal provide a smaller localized area of hard supporting asperities where boundary layer shear will take place in the smeared solid lubricant thereover to further reduce friction (similar to micro-grooving), and (ii) the adherent metal network created as a result of melting only the outer skin of the soft metal shells during plasma spraying.

Figure 13:
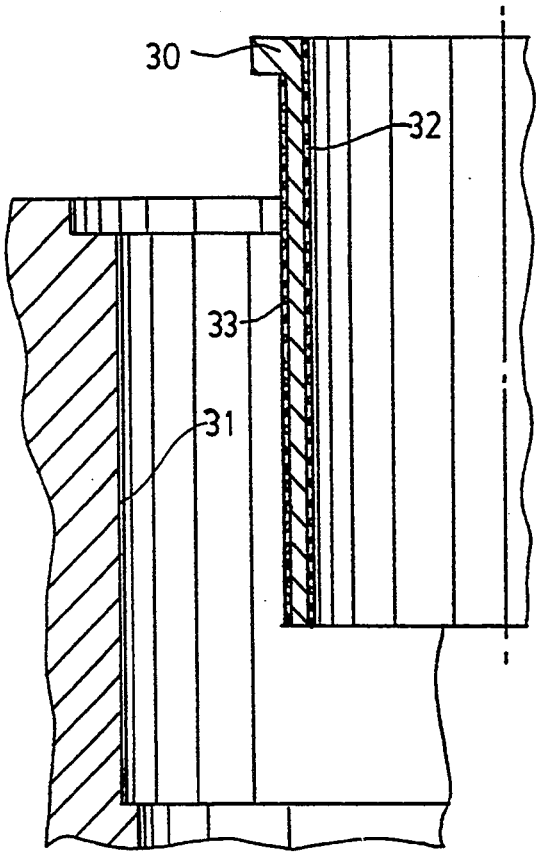
FIG. 13 is an enlarged sectional view of a portion of the liner in position for being installed in a cylinder block bore.

As shown in FIG. 13, if a liner is used as the surface to be coated, the liner 30 would be preferably constituted of the same material as that of the parent bore surface 31. However, the liner can be any metal that has a higher strength as the metal of the parent bore wall; this is often achieved by making an alloy of the metal used for the parent bore wall. For example, C-355 or C-356 aluminum alloys for the liner are stronger than the 319 aluminum alloy commonly used for aluminum engine blocks. The liner must have generally thermal conductivity and thermal expansion characteristics essentially the same as the block. Preferably, only the liner 30 is coated interiorly at least at the upper region 32, as will be described subsequently, and the liner then assembled to the parent bore by either being frozen to about a temperature of −40° F. while maintaining the parent bore at room temperature, or the parent bore may be heated to 270° F. while the liner is retained at room temperature, or possibly a combination of the two procedures. In either case, a shrink-fit is obtained by placing the liner in such differential temperature condition within the parent bore. Preferably, the liner is coated at 33 (at room temperature) on its exterior surface with a copper flake epoxy mixture, the epoxy being of the type described for use in coating. The copper flake within such epoxy coating assures not only an extremely solid bond between the liner and the light metal parent bore, but also increases the thermal transfer therebetween on a microscopic scale.

Plasma spraying of the flowable powder is carried out to form an adherent porous layer of powder grains, the powder consisting of particles of solid lubricant encapsulated in a soft metal shell. The flowable powder can be and often is a composite of the solid film lubricant and the soft metal powder produced by spray drying in which a combustible, ash-free, organic binder (such as 1% carbowax) and/or 0.5% gum arabic are used to produce the slurry from which the spray-dried powder is produced. Secondly, the coating is honed to a thin thickness 34 of about 25–60 microns to expose the core solid lubricants at 35 as well as present shell edges 36 which additionally provide lubricating qualities (see FIG. 4).

It is desirable to not only have powder grains of solid lubricant encased in a soft metal shell, such as nickel, but also powder grains of a solid hard metal such as FeCrMn or FeMn. The outer shells of these two different grains will melt and alloy .fuse during plasma spraying to create an even harder alloyed metal network such as FeCrNiMn and FeNiMn.

The coating is plasma sprayed onto the substrate in a deposited thickness range of about 40–140 microns. The substrate surface is preferably cleansed to provide fresh metal prior to plasma spraying, or is given a phosphate pretreatment. The surface is prepared by degreasing with OSHA approved solvent, such as ethylene dichloride, followed by rinsing with isopropyl alcohol. The surface is grit blasted with clean grit. Alternately, the surface can be cleaned by etching with dilute HF and followed by dilute $HNO_3$ and then washed and rinsed. Wire brushing also helps to move the metal around without burnishing. The flowable powder useful for such plasma spraying preferably has an average particle size in the range of 20–75 microns, but for practical high volume production, such range should be restricted to 30–55 microns. Grains of 30–55 microns are freely flowable, which is necessary for feeding a plasma gun. If less than 30 microns, the powder will not flow freely. If greater than 55 microns, stratification will occur in the coating lacking uniform comingling of the particles. This does not mean that particle sizes outside such range must be scraped for an economic loss; rather, the finer particles can be agglomerated with wax to the desired size and oversized particles can be ball-mixed to the desired size. Thus, all powder grains can be used.

The solid lubricants, which form the core of such encapsulated grains, are of the previously described class of graphite, molybdenum disulfide, and additionally may contain calcium fluoride, sodium fluoride, lithium fluoride, boron nitride, and tungsten disulfide. The soft metal shell is selected form the class of nickel, boron, cobalt, copper, zinc, tin, magnesium and iron, or alloys of such selected metal.

Figure 14:
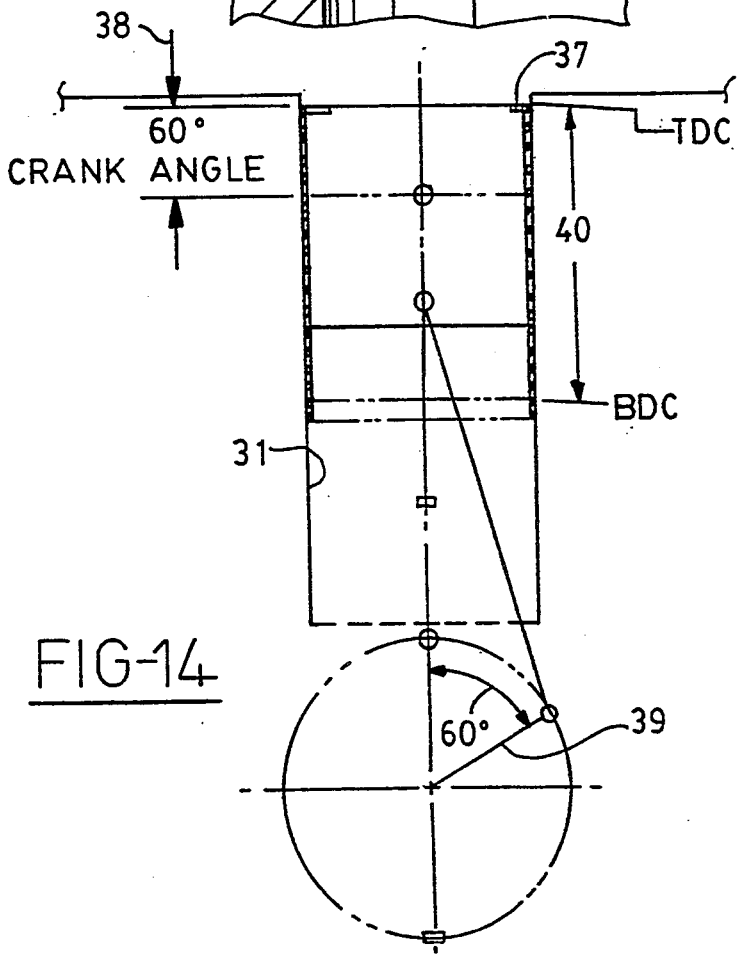
FIG. 14 is a schematic illustration of the mechanics involved in reciprocating a piston within a cylinder bore showing the travel of the piston rings which promote a loading on the cylinder bore coating system.

It is, in most cases, necessary to coat only a segment of the entire cylinder bore surface. As shown in FIG. 14, the location of conventional sliding piston rings 37 moves linearly along the bore wall 31 a distance 38. The locus of the piston ring contact with the coating is moved by the crank arm 39 during an angle representing about 60° of crank movement. This distance is about one-third of the full linear movement 40 of the piston rings (between top dead center—TDC, and bottom dead center—BDC). The distance 38 represents the hot zone of the bore wall where lubrication can vary and the bore wall is most susceptible to drag and piston slap, and which is the source of a significant amount of engine friction losses while causing scuffing of the bore wall in case of wet lubricant failure. When the coating is limited to a segment of the bore wall depth, it is desirable to use an overlayer of an organic polymer with solid lubricant over the shortened coating as well as the rest of the bore. A discontinuity or step may be created between the shortened coating and the parent bore wall; such a step can cause piston ring instability. Honing of the step reduces its severity, but the overlayer will eliminate or reduce any step.

Figure 15:
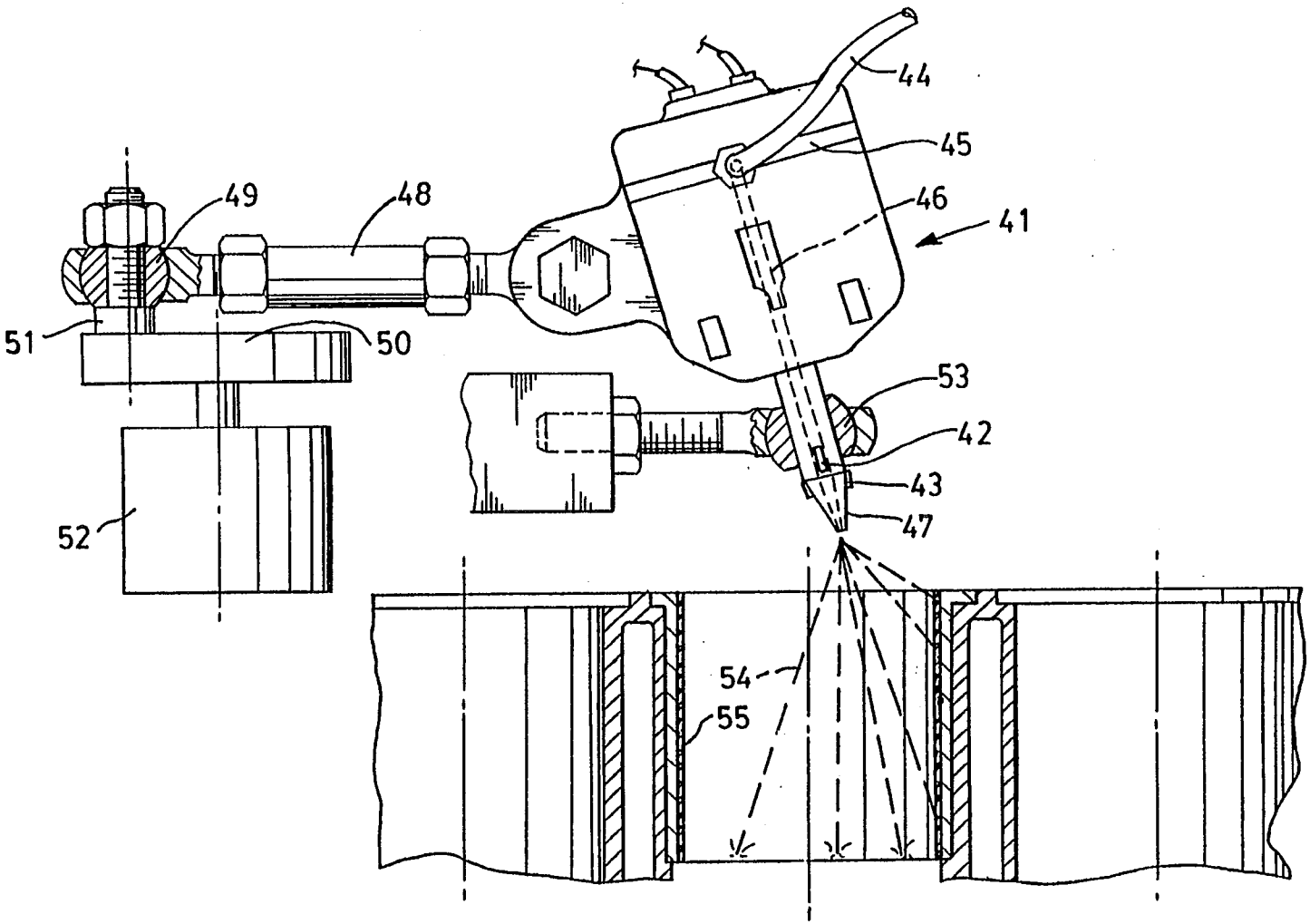
FIG. 15 is a view of the coating apparatus for depositing at high temperatures a plasma coating on a cylinder bore shown in cross-section.

Plasma spraying may be carried out by equipment, as illustrated in FIG. 15, using a spray gun 41 having a pair of interior electrodes 42, 43 that create an arc through which powdered metal and inert gas are introduced to form a plasma. The powder metal may be introduced through a supply line 44 connected to a slip ring 45 that in turn connects to a powder channel 46 that delivers to the nozzle 47. The plasma heats the powder, being carried therewith, along the shells of the powder only. The gun is carried on an articulating arm 48 which is moved in a combined circular linear movement by a journal 49 carried on an eccentric positioner 51 which in turn is carried on a rotating disc 50 driven by a motor 52. The nozzle 47 of the gun is entrained in a fixed swivel journal 53 so that the spray pattern 54 is moved both annularly as well as linearly up and down the bore surface 55 as a result of the articulating motion of the gun.

Figure 16:
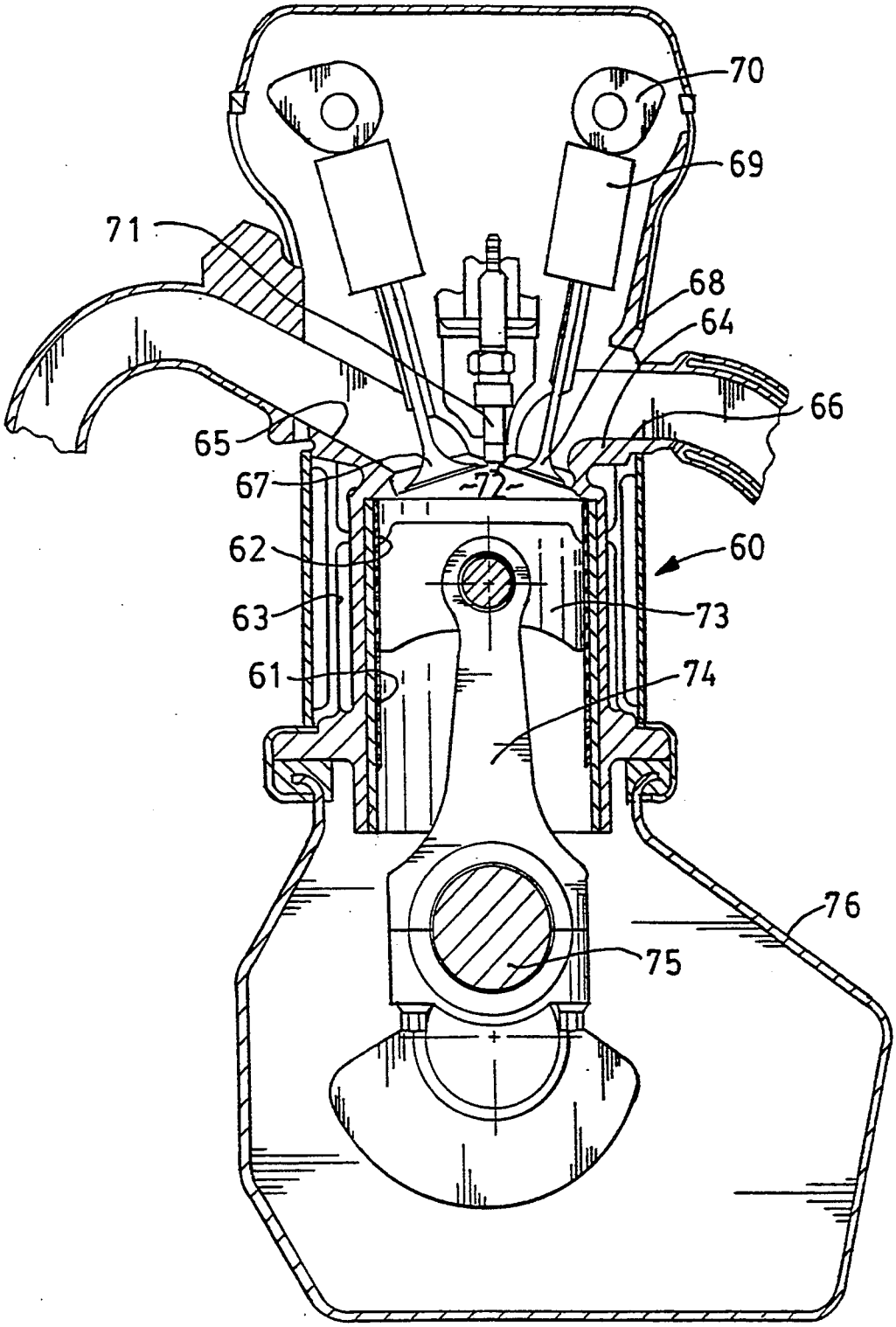
FIG. 16 is a cross-sectional illustration of an internal combustion engine containing the product of this invention showing one coated cylinder bore in its environment for reducing the total engine friction, vibration, and fuel consumption for the operation of such engine.

Yet another aspect of this invention is the completed product resulting from the practice of the method and use of the chemistry described herein. As shown in FIG. 16, the product is an engine block 60 having one or more anti-friction coated cylinder bore walls 61, comprising: a coating 62 of powder grains fused to the cylinder bore wall 61, the grains being comprised of at least solid lubricant particles encapsulated within a soft metal shell, said shells being fused together to form a network with limited porosity, the solid lubricant comprising graphite and $MoS_2$; and wet oil lubrication retained within the porosity of the coating. The soft metal of the coating should have a hardness no greater than 60 Rc. The metal of the cylinder wall is preferably selected from the group of aluminum, titanium, magnesium, and alloys of such metals with copper, zinc, or silicon. The soft metal again may additionally comprise a small amount of alloy metal adherently compatible with the cylinder bore wall metal.

Such product is characterized by a reduction in engine friction resulting from reduction of piston system friction of at least 25% because of the reduction in boundary layer friction as well as the ability to operate the engine with a near zero piston/cylinder bore clearance. Furthermore, such product provides for a reduction in engine hydrocarbon emissions by at least 25% because of the adaptation of the piston ring designs, disclosed in concurrently filed patent applications, and thereby reduce the top land crevice volume. The blow-by of the engine (combustion gases blowing past the piston rings) is reduced also by about 25% because of the near zero clearance combined with the piston ring design just cited. The temperature of the coolant used to maintain proper temperature of the engine can be reduced by 2° F. because a significantly lower viscosity oil can be used with such change. The oil temperature can be reduced by at least 50° F. when coupled with the avoidance of tar deposit formation on the combustion chamber surfaces, and an increase in the compression ratio of the engine by at least one with attendant improvement in fuel economy and power.

Another significant aspect of the coated block, in accordance with this invention, is the ability for resisting formic acid, formed when using flex fuels containing methanol. Typically, an engine would have its surfaces degrade at 20,000 miles or greater as a result of the formation of formic acid under a peculiar set of engine conditions with such flex fuels. With the use of the coated bore walls as herein, such resistance to formic acid corrosion is eliminated. Moreover, the coated product obtains greater accuracy of roundness within the cylinder bore as the conventional rings ride thereagainst, contributing to the reduction in blow-by and friction as mentioned earlier. Friction reduction is obtained due to a reduction in the boundary friction component as well as the reduction in the boundary/dry friction coefficient itself.

The coated block plays an important role in the overall operation of engine efficiency. As shown in FIG. 16, the block has an interior cooling jacket 63 along its sides and cooperates to receive a head 64 containing intake and exhaust passages 65, 66 opened and closed by intake and exhaust valves 67, 68 operated by a valve train 69 actuated by camshafts 70. The combustible gases are ignited by spark ignition 71 located centrally of the combustion chamber 72 to move the piston 73, which in turn actuates a connecting rod 74 to turn a crankshaft 75 rotating within a crank case 76. Oil is drawn from the crank case 76 and splashed within the interior of the block to lubricate and bathe the piston 73 during its reciprocal movement therein. The cooling fluid circulates about the cylinder bore wall to extract heat therefrom, which influences the efficiency of the engine by reducing the heat input into the air/fuel charge during the intake stroke, and thus increases volumetric efficiency as well as power and fuel economy.

We claim:

1. A method of making an anti-friction coating on a metal surface subject to sliding wear, comprising:

(a) forming a powder having grains comprising a core of solid lubricant of graphite and $MoS_2$ and a shell of fusable metal having a hardness no greater than Rc40;

(b) plasma spraying said powder onto a metal surface to form a coating; and (c) finish-smoothing said coating to a uniform thickness of about 25–175 microns.

2. The method as in claim 1, in which said coating is deposited in a thickness range of 40–250 microns.

3. The method as in claim 1, in which said metal surface is cleansed to freshly expose said metal just prior to plasma spraying.

4. The method as in claim 3, in which said cleansed metal surface is given a phosphate pretreatment.

5. The method is in claim 1, in which said metal surface is a cylinder bore wall of an internal combustion engine.

6. The method as in claim 5, in which said bore wall is liner inserted into the block of said engine or cast-in-place.

7. The method as in claim 1, in which said powder grains have an average size in the range of 25–55 microns.

8. The method as in claim 1, in which said core additionally comprises at least one of hexagonal BN, $CaF_2$, LiF, $WS_2$, and eutectic mixtures of $LiF/NaF_2$ or $LiF/CaF_2$.

9. The method as in claim 1, in which said metal is selected from the group consisting of Al, Ti, Mg, and an alloy of such metal with Sn, Zn, Cu, or Si.

10. The method as in claim 1, in which said plasma has a temperature of at least 1200° C.

11. The method as in claim 1, in which said powder further comprises grains of wear-resistant material residing either as cores of material in a metal shell or as the entire grain, and said smoothing is carried out by honing.

12. The method as in claim 1, in which an emulsion layer of a mixture of solid lubricant particles and a thermoset polymer is deposited over said smoothed coating.

13. The method as in claim 12, in which said solid lubricant particles of said layer comprise at least two selected from the group of graphite, BN, and $MoS_2$.

* * * * *